United States Patent [19]

Fish

[11] 4,230,789

[45] Oct. 28, 1980

[54] THERMAL DIAZOTYPE SHEETS

[75] Inventor: Herbert J. Fish, Oakdale, Minn.

[73] Assignee: Minnesota Mining and Manufacturing Company, Saint Paul, Minn.

[21] Appl. No.: 885,877

[22] Filed: Mar. 13, 1978

[51] Int. Cl.[2] ..... G03C 1/60

[52] U.S. Cl. ..... 430/159; 430/151; 430/160; 430/162; 430/173; 430/174

[58] Field of Search ..... 96/49.75, 91 R

[56] References Cited

U.S. PATENT DOCUMENTS

| | | | |
|---|---|---|---|
| 3,199,982 | 8/1965 | Kashiwabara | 96/91 R |
| 3,255,007 | 6/1966 | Kosar | 96/75 |
| 3,294,534 | 12/1966 | Halperin | 96/49 |
| 3,386,828 | 6/1968 | Slimowicz | 96/91 R |
| 3,520,691 | 7/1970 | Schelor et al. | 96/49 |
| 3,754,916 | 8/1973 | Winslow et al. | 96/49 |
| 3,910,794 | 10/1975 | Buisine et al. | 96/91 R |
| 4,168,171 | 9/1979 | Winslow et al. | 96/75 |

FOREIGN PATENT DOCUMENTS

| | | | |
|---|---|---|---|
| 43-4926 | 2/1968 | Japan | 96/91 R |
| 43-7578 | 3/1968 | Japan | 96/91 R |
| 44-11944 | 5/1969 | Japan | 96/75 |
| 45-18422 | 6/1970 | Japan | 96/91 R |
| 51-73431 | 6/1976 | Japan | 96/75 |

OTHER PUBLICATIONS

Chemical Abstracts, vol. 84, 1976, #158032f, (Motoki et al., Japan KoKai, 75, 138, 821, 11/1975).

Chemical Abstracts, vol. 86, 1977, #163614t, (Saito et al., Japan KoKai, 76, 103, 423, 3/1975).

*Primary Examiner*—Charles L. Bowers, Jr.

*Attorney, Agent, or Firm*—Cruzan Alexander; Donald M. Sell; Mark A. Litman

[57] ABSTRACT

Thermal diazotype sheets having substituted imidazoline acid-neutralizers are shown to have shelf stability and short development times.

5 Claims, No Drawings

THERMAL DIAZOTYPE SHEETS

Diazotype imaging materials contain at least two active agents and usually require a third active agent to perform well. The first two agents are an acid-stabilized diazonium salt and an azo-coupler compound. The diazonium salt is stabilized against spontaneous reaction with itself and the azo-coupler by the presence of an acid environment. The image produced by diazotype materials is formed from the resulting dye of a reaction between a diazonium salt and the azo-coupler compound. A diazotype sheet containing only these two agents would not be of significant use in competition with modern imaging techniques because a protracted development time would be necessary to overcome the stabilization of the diazonium salt, or reduced amounts of acid would have to be used which would render the sheet less storage stable and of little practical use. It has therefore been the practice of the art to add active or latent acid-neutralizing compounds (basic materials) into the sheet in order to enable the diazonium salt and the azo-coupler to couple and form a dye more easily. The acid-neutralizing compounds have commonly been made available for neutralization in various manners including the direct application of gaseous bases (e.g. ammonia), the physical application of liquid bases, or by the application of heat to liberate bases. For example, heat could cause the evolution of acid-neutralizing components (e.g., U.S. Pat. No. 2,732,299) or could enable migration of acid-neutralizing components into a layer containing the acid stabilized diazonium salt by heat softening of a binder or barrier layer (e.g., British Pat. No. 1,032,508). Other methods of contacting the acid-stabilized salt with a neutralizer includes the gross application of a basic material to the surface of the diazonium sheet (e.g., U.S. Pat. No. 3,199,982).

U.S. Pat. No. 3,754,916 discloses that benzimidazole compounds are particularly outstanding as an acid-neutralizer and provides a storage stable material when the benzimidazole compound is included within a heat-softenable binder and also provides excellent imaging characteristics to diazotype sheets. The acid stabilized diazonium salts are separated from the benzimidazole by a heat softenable binder which either is a layer containing the benzimidazole compounds coated next to the layer containing the acid stabilized diazonium salt or else a heat softenable binder layer is used between the respective layers containing the acid stabilized salt and the benzimidazole compound. These benzimidazole compounds provided significant advance in the art, but any improvements thereon would, of course, be desirable.

Typical reaction times for the diazotype sheets shown in U.S. Pat. No. 3,754,916 were at least 40 seconds at 260° F. (126° C.) to react all of the dye forming components in the sheet. This 40 second development time could be shortened by putting less acid into the dye forming coating layer, which results in poor storage properties, or by higher development temperatures which can reduce the resolution of the image. To decrease the development time by these methods was to sacrifice other desirable properties. An alternative method for reducing the development time would be to increase the amount of benzimidazoles in the sheet. This approach is limited by the solubility limits of the benzimidazoles in commonly used solvent systems.

U.S. Patent Application Ser. No. 822,069, filed Aug. 5, 1977, now U.S. Pat. No. 4,168,171, discloses the use of imidazoles and substituted imidazoles as good neutralizing agents. It has been found in the present invention that certain compounds structurally similar to imidazoles, namely imidazolines, can be useful as neutralizing agents for thermally developable diazo sheets, but that the substitution tolerable on the imidazolines is often different than that allowable on imidazoles, the compounds behaving differently in spite of apparent structural similarities.

It is to be noted that the neutralizing ability of acid-neutralizers is a direct function of their basic nature. It would be readily thought that given two compounds of similar size and structure that the more basic compound would neutralize acids more rapidly in an acid-stabilized diazotype system and that they would also tend to have poorer shelf stability. Given the similarity amongst benzimidazole, imidazole and imidazolines, it is surprising that imidazolines, which as a class are much stronger bases than either benzimidazoles or imidazoles, can have excellent shelf stability.

According to the present invention, diazotype elements are disclosed which have good storage stability and which have comparable and good development times for diazotype sheets. Particularly imidazoline compounds are used as acid-neutralizing agents carried in heat-softenable binder layers in diazotype sheets which form images from acid stabilized diazonium salts and azo-coupler compounds.

Diazonium salts which find utility in this invention are those which are capable of coupling with azo-coupler compounds in weakly basic environments to form dyes. Of the many diazonium salts which may be used in this invention, the following have given good results:

p-amino-N-benzyl-N-ethyl-benzenediazonium chlorostannate, p-amino-N-benzyl-N-ethylbenzenediazonium chloro-zincate, 3-chloro-4-diethylaminobenzenediazonium chlorozincate, p-diethylaminobenzenediazonium fluoroborate, p-diethylamino-2-ethoxybenzenediazonium chlorozincate, 4-diethylamino-2-methylbenzenediazonium chlorozincate, p-morpholinobenzenediazonium fluoroborate, p-diazo-N-methyl-N-hydroxyethylaniline zinc chloride, p-diazo-N-ethyl-o-toluidine zinc chloride, p-diazo-N-diethyl-m-phenetidine zinc chloride, p-diazomorpholino-2,5-diethoxybenzene zinc chloride, p-diazomorpholino-2,5-dibutoxybenzene boro fluoride, p-diazo(4'-toluyl)-mercapto-2,5-dimethoxybenzene zinc chloride, 4-diazo-1',2,5-triethoxydiphenyloxalate, p-diazomorpholino-2,5-dibutoxybenzene zinc sulfate, p-diazodimethyl aniline 1/1-$ZnCl_2$, p-diazo diethyl aniline zinc chloride, p-diazo-N-hydroxyethyl-N-ethylaniline-½ zinc chloride, p-diazo-N-ethyl-N-benzylaniline zinc chloride, 4-diazophenylmorpholine zinc chloride, 1-diazo-4-benzoylamino-2,5-diethoxybenzene zinc chloride. Preferred diazonium salts include: p-diazomorpholino-2,5-dibutoxybenzene borofluoride, p-diazomorpholino-2,5-dibutoxybenzene zinc sulfate, 4-diazophenylmorpholine zinc chloride. Light-sensitive diazonium salts are preferably used.

Azo-coupling compounds which find utility in this invention are those which will couple with diazonium salts in weakly basic environments to form dyes. Such couplers include: 2,3-dihydroxy naphthalene, 2,3-dihydroxynaphthalene-6-sulfonic acid sodium salt, 2,7-dihydroxynaphthalene, 1,7-dihydroxynaphthalene, phloretin, acetoacetanilide, aceto-acet-o-ansidide, 3-methyl-p-sulfophenyl-5-pyrazolone, aceto-acet-2,5-dimethoxyanilide, aceto-acet-p-toluidide, aceto-acet-2,4-xylidide, 2,6-dihydroxy toluene, 3-methyl-1-phenyl-5-pyrazolone, 2'-chloroacetanilide, ethylenediaminebisacetoacetamide, N,N-ethylenebisacetoacetamide, γ-naphtol, β-naphtol, 1,4-dihydroxynaphthalene. Azo-couplers commonly used in the dying of textiles have proven especially useful, such as the following: 3-hydroxy-2-naphtho-o-phenetitide, 3-hydroxy-2-naphtho-o-toluidide, 5'-chloro-3-hydroxy-2',4'-dimethoxy-2-naphthanilide, 3-hydroxy-2',5-dimethoxy-2-naphthanilide, 3-hydroxy-2-naph-o-anisidide. Light-sensitive azo-coupler compounds may be used, as taught in U.S. Pat. No. 3,094,417.

Two or more azo-coupler compounds may be incorporated within the diazotype sheet of the present invention to produce dyes which together exhibit desirable spectral absorption characteristics. For example, in a preferred embodiment, the dyes resulting from the coupling of p-diazomorpholino 2,5-diethoxy boro fluoride with acetoacetanilide, 2,3-dihydroxynaphthalene, and 3-hydroxy-2-naphtho-o-toluidide are yellow, reddish-purple, and cyan, respectively, and together form substantially black images.

It is often desirable to incorporate acidic compounds, such as oxalic acid, in diazotype sheets which contain highly-reactive diazonium salts for the purpose of inhibiting self-coupling reactions. Diazotype sheets which contain less highly-reactive diazonium salts generally require proportionately reduced amounts of acidic compounds, and many diazonium acid-salts exhibit sufficient stability without the addition of other acidic compounds.

A binder material, normally polymeric, is preferably used to contain the reactive components in layers in the diazotype sheets of the present invention. The binder materials and barrier materials are preferably thermoplastic and soften sufficiently at reasonable development temperatures to permit imidazoline compounds to readily migrate therethrough. Thermoplastic binder materials in addition should be sufficiently rigid at normal storage temperatures to hinder such migration. It is desirable that the binder materials used in the present invention be capable of forming continuous films. Examples of such polymeric binder materials include polyvinyl chloride acetate, polystyrene, polymethylmethacrylate, etc. Such binder materials are preferably chosen to be compatible with the components incorporated therein, i.e., capable of forming a single phase system with such components, and permit the ready migration of imidazoline compounds therethrough upon heating. However, polymeric binder materials which are incompatible with the components contained therein, such as polymeric latices, may often be advantageously utilized. Binder materials which permit the migration therethrough of chemical compounds such as imidazoline compounds, couplers, and the like are generally known to the art, and the selection therefrom is not critical to the present invention.

The supporting substrates for the layers of the present invention may be or any suitable material such as plastic film, glass, paper, metal, cloth, wood, etc. Plastic films, such as polyester and cellulose triacetate, are preferred. The substrates desirably should have a heat-distortion temperature sufficiently high to permit reasonable development temperatures to be used without damage thereto. It is contemplated, however, that substrates having lower heat-distortion temperatures may be desirable, as, for example, when a wrinkled design pattern is desired. It is further contemplated that a separate supporting layer may be advantageously eliminated in some cases, as when at least one of the binder materials is a self-supporting film.

The diazotype sheets of the present invention may be prepared by a variety of methods, such as consecutively coating polymer emulsions containing reactive components upon a substrate to form layers; laminating together reactive component-containing layers, etc. Preferably, however, the reactive components and polymeric binder material for each layer are combined in a solution which is coated and dried to form a layer. The solvent for each solution is preferably a non-solvent for the binder material of the preceding layer, thereby avoiding the migration which might otherwise occur should a solvent be capable of dissolving the binder material of the preceding layer to liberate the reactive components contained therein.

Imidazoline has the structural formula

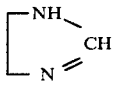

as compared to imidazole which has the structural formula

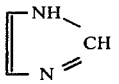

the salient difference in imidazoline being the absence of a double bond between the 4- and 5-position carbons. As acid-neutralizers for diazo sheets, however, similarly structured compounds behave quite differently, even when identically substituted. There is in fact no strong correlation between the usefulness of substituted imidazoles and imidazolines.

Useful substituted imidazolines according to the present invention may be represented by the formula

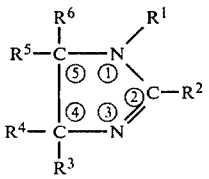

wherein $R^1$ is H, phenyl or furyl, $R^2$ is phenyl, alkyl ($C_{11}$–$C_{20}$), benzyl, o-tolyl, and furyl $R^4$ is H, alkyl ($C_1$–$C_4$), and furyl, and $R^5$ is H, alkyl ($C_1$–$C_4$), or furyl $R^3$ and $R^6$ are H or lower alkyl ($C_1$–$C_4$).

It is preferred that if $R^4$ or $R^5$ is furyl, $R^3$ or $R^6$ should be H.

The 4- and 5-positions on the imidazoline nucleus are equivalent due to tautomerization of the 1–2 N-C and 2–3 N=C bonds.

The neutralizing imidazolines of the present invention may be used as part of the neutralizing additives in a diazotype sheet or as the sole component. It has been found desirable to have at least 25% by weight of all acid-neutralizing materials in the sheet comprised of the imidazolines of the present invention. A composition comprising at least 50% of the imidazolines of the invention as the acid-neutralizer material is more preferred, and a 75% minimum is most preferred. Benzimidazoles, imidazoles, or other known acid-neutralizer materials may be used to make up the remaining percentages.

The following examples will assist in an understanding of the present invention.

EXAMPLES 1-6

The following examples show the significant differences between identically substituted imidazoles and imidazolines in identical diazo emulsions.

Two standard coating solutions were prepared as a basis for the comparison and evaluation of imidazole an imidazoline neutralizing agents for the thermal diazo sheets. The first solution comprised:

20.00 g vinylchloride-vinyl acetate (50/50) copolymer
44.60 g methylisobutylketone
23.07 g acetone
9.70 g cyclohexanone
0.30 g 2,3-dihydroxynaphthalene
0.18 g o-acetoacetanisidide
0.15 g acetoacet-o-chloroanilide A second coating solution was formulated as follows:

7.00 g polyvinyl butyral
70.33 g methanol
20.00 g n-butanol
0.44 g 3-hydroxy-2'-methyl-2-naphthanilide-o-toluidide
0.44 g 3-oxynaphthoic acid-o-phenetidide
0.45 g 5-sulfosalicyclic acid
1.34 g p-diazo-2,5-diethoxy-4-morpholino benzene borofluoride In each of the examples $1.695\times10^{-2}$ moles of neutralizer was added to the first coating solution. The first solution was coated on polyester film then dried to a coating weight of about 0.104 g/m$^2$ by heating to 95° C. for two minutes. The second coating was applied and dried to about 0.035 g/m$^2$ by heating at 49° C. for 2.5 minutes. Development was effected by heating at 127° C. The maximum optical density was measured, and the time to react that maximum density was recorded. Samples were natural aged at ambient conditions (20°-25° C., 30-60% relative humidity) or with accelerated aging (converted to nautral gas equivalent units) and the Dmin and Dmax measured after development. The results were as follows:

| Compound | Dmax | Seconds to Dmax | Shelf Aging | Example |
|---|---|---|---|---|
| 2-ethyl-4-methyl-imidazole | 1.35 | 60 | F | 1 |
| 2-ethyl-4-methyl-imidazoline | 2.00 | <2.0 | P | 2 |
| 2-phenyl-imidazole | 1.95 | 60 | E | 3 |
| 2-phenyl-2-imidazoline | 1.96 | 15 | E | 4 |
| 2-methyl-imidazole | 2.00 | 6.0 | P | 5 |
| 2-methyl-2-imidazoline | 2.00 | <1.0 | P | 6 |

As can be seen from these results, there is no way to correlate the total behavior of substitution on imidazoles to the behavior of the same substituents on imidazolines. Imidazoles and imidazolines act significantly differently in thermal diazo systems with regard to rate of development.

EXAMPLES 7-12

The above formulations were evaluated using 1.0 molar equivalents of 2-undecyl imidazoline and 1,4,5-trifuryl-2-imidazoline. Also evaluated were 1.5 molar equivalents of 1,4,5-trifuryl-2-imidazoline and 0.75, 0.50, and 0.25 molar equivalents of 2-phenyl-2-imidazoline.

| Compound | Dmax | Molar Eq. | Seconds to Dmax | Shelf Aging | Ex. |
|---|---|---|---|---|---|
| 2-undecyl-2-imidazoline | 2.0 | 1.0 | 7.0 | P | 7 |
| Trifuryl-2-imidazoline | 1.84 | 1.0 | 6.0 | V.G.-E | 8 |
| Trifuryl-2-imidazoline | 2.0 | 1.5 | <1.0 | P | 9 |
| 2-phenyl-2-imidazoline | 2.0 | 0.75 | 20 | E | 10 |
| 2-phenyl-2-imidazoline | 1.75 | 0.50 | 40 | E | 11 |
| 2-phenyl-2-imidazoline | 0.85 | 0.25 | 40 | E | 12 |

As can be seen from these data, these imidazolines are fast acting and can provide excellent shelf stability.

EXAMPLES 13-15

The standard formulations described above were duplicated in these examples except that the 0.18 g of o-acetoacetaniside was replaced with 0.18 g acetoacet-o-chloranilide, thus providing 0.33 g of the latter. 1.0 molar equivalents of neutralizers as compared to Examples 1-6 were used in all instances.

| Compound | Dmax | Seconds to Dmax | Shelf Aging | Example |
|---|---|---|---|---|
| 1,5-tetramethylene 2-o-tolyl-imidazoline* | 0.75 | 30 | V.G. | 13 |
| 2-benzyl-2-imidazoline | 0.81 | 30 | V.G. | 14 |
| 1-ethyl-2-phenyl-2-imidazoline | 0.25 | 30 | V.G. | 15 |

*

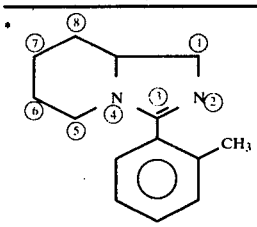

The shelf aging properties of imidazolines are especially apparent here. It is also apparent that the 1-position should not have an alkyl substitutent as this seriously affects the Dmax.

EXAMPLES 16-18

The following examples show the use of additional imidazoline acid-neutralizers according to the present invention.

A solution comprising 44.6 parts by weight methylisobutylketone, 23.0 parts acetone, 9.7 parts cyclohexanone, and 20.0 parts of a vinyl chloride-vinylacetate (50/50 by weight) copolymer was prepared. To 39.4 grams of this solution was added 10.6 grams of a 20% solution of 1,2-diphenyl-4,4-dimethyl-2-imidazoline in toluene as Example 16. To an aliquot of 38.6 grams of the first solution was added 11.4 grams of a 16.5% solution of 1,2-diphenyl-2-imidazoline in toluene as Example 17. To a 48.82 grams aliquot of the first solution was added 1.18 grams of 2-n-pentyl-2-imidazoline as Example 18. Each of these final solutions was coated out on polyethyleneterephthalate film at 0.102 g/m$^2$ and dried for 3 minutes at 95° C. A second coating was applied which was identical in composition to that of Examples 1–6 at the same weight/area and with the same drying conditions.

Each material was developed by uniform heating at 126.7° C. for 40 seconds. Each sample was also tested for shelf stability using an accelerated aging test of 72 hours at 38° C. The results are tabulated below.

| Example | Dmax | Aging |
|---|---|---|
| 16 | 1.00 | E |
| 17 | 1.55 | F |
| 18 | 1.00 | P |

In the previous examples, the quantitative evaluation of shelf stability is determined when visible precoupling occurs without heat development. The samples in the tables represent the following values: P is less than 3 months shelf stability; F is less than 6 months shelf stability; V.G. is 6 to 9 months shelf stability; and E is more than 9 months shelf stability.

What is claimed is:

1. A heat reactive diazotype sheet having at least two layers, with one layer coated upon the other, one of said layers comprising a heat-softenable binder material and an acid-stabilized light sensitive diazonium salt capable of reacting with an azo-coupler compound to form a dye, and the other of said layers comprising a heat-softenable binder material and an acid-neutralizer component capable of providing basic equivalents in an amount at least sufficient to neutralize said acid stabilization of said diazonium salt so as to provide a weakly basic environment for the diazonium salt in the sheet and to render said acid-stabilized diazonium salt reactive with said azo-coupler compound, and at least one of said layers containing an azo-coupler, said diazotype sheet being characterized by said acid-neutralizer component being comprised of at least 25% by weight imidazoline acid-neutralizer compound selected from the group consisting of 2-phenyl-2-imidazoline, 1,5-tetramethylene-2-o-tolylimidazoline, 2-benzyl-2-imidazoline, trifuryl-2-imidazoline, and 1,2-diphenyl-4,4-dimethyl-2-imidazoline.

2. A heat reactive diazotype sheet having at least two layers on a support layer, one of said layers comprising a heat-softenable binder material and an acid-stabilized light-sensitive diazonium salt capable of reacting with an azo-coupler compound to form a dye, and the other of said layers comprising a heat-softenable binder material and an acid-neutralizer component capable of providing basic equivalents in an amount at least sufficient to neutralize said acid stabilization of said diazonium salt so as to provide a weakly basic environment for the diazonium salt in the sheet and to render said acid-stabilized diazonium salt reactive with said azo-coupler compound, and at least one of said layers containing an azo-coupler, said diazotype sheet being characterized by said acid-neutralizer component being comprised of at least 25% by weight imidazoline acid-neutralizer compound selected from the group consisting of 2-phenyl-2-imidazoline, 1,5-tetramethylene-2-o-tolylimidazoline, 2-benzyl-2-imidazoline, trifuryl-2-imidazoline, and 1,2-diphenyl-4,4-dimethyl-2-imidazoline.

3. The diazotype sheet of claim 2 wherein said acid neutralizer component comprises at least 75% by weight of said imidazoline acid neutralizer compound.

4. The diazotype sheet of claim 2 wherein said imidazoline acid neutralizer compound is 2-phenyl-2-imidazoline.

5. The diazotype sheet of claim 3 wherein said imidazoline acid neutralizer compound is 2-phenyl-2-imidazoline.

* * * * *